US009771134B2

(12) United States Patent
Gai et al.

(10) Patent No.: US 9,771,134 B2
(45) Date of Patent: Sep. 26, 2017

(54) DEVICE FOR CONTROLLING TRIM OF A BOAT

(71) Applicants: Marcella Gai, Genoa (IT); Marco Campagna, Genoa (IT); Giampiero Bressan, Busalla (IT)

(72) Inventors: Marcella Gai, Genoa (IT); Marco Campagna, Genoa (IT); Giampiero Bressan, Busalla (IT)

(73) Assignee: Ultraflex S.p.A., Casella (GE) (IT)

( * ) Notice: Subject to any disclaimer, the term of this patent is extended or adjusted under 35 U.S.C. 154(b) by 22 days.

(21) Appl. No.: 14/580,275

(22) Filed: Dec. 23, 2014

(65) Prior Publication Data

US 2015/0191216 A1 Jul. 9, 2015

(30) Foreign Application Priority Data

Jan. 2, 2014 (IT) ..... GE2014A0001

(51) Int. Cl.
*B63B 39/06* (2006.01)
*B63B 1/32* (2006.01)
*B63B 1/22* (2006.01)

(52) U.S. Cl.
CPC ..... *B63B 39/061* (2013.01); *B63B 1/22* (2013.01); *B63B 1/32* (2013.01)

(58) Field of Classification Search
CPC ..... B63B 1/32; B63B 39/061; B63B 1/22
USPC ..... 114/285–287
See application file for complete search history.

(56) References Cited

U.S. PATENT DOCUMENTS 2,864,330 A * 12/1958 Cochran ..... B63H 25/44 114/145 A
3,391,667 A * 7/1968 Lo Bue ..... B63B 39/061 114/285
3,399,643 A * 9/1968 Bennett ..... B63B 39/061 114/285
3,628,484 A * 12/1971 Banner ..... B63B 39/061 114/285
6,167,830 B1 * 1/2001 Pilger ..... B63B 39/061 114/285
6,823,812 B2 * 11/2004 von Wolske ..... B63B 39/061 114/286
8,631,753 B2 * 1/2014 Morvillo ..... B63B 39/061 114/285

FOREIGN PATENT DOCUMENTS

WO 2011142870 11/2011

* cited by examiner

*Primary Examiner* — Ajay Vasudeva
(74) *Attorney, Agent, or Firm* — Themis Law

(57) ABSTRACT

Device for controlling the trim of a boat including at least one trim tab element or the like, engaged to the transom of the boat by a hinge. At least one actuator is also provided, which is affixed to the transom by an upper terminal and to the tab by a lower terminal respectively through an upper joint and a lower joint. The lower joint includes at least two parts, of which a first part is connected to the lower terminal of the actuator and a second part includes a lower bracket affixed to the tab by fastener means, which are engaged in corresponding engagement seats on the lower bracket and the tab. The first part includes a terminal element, which is provided in a housing seat formed on the lower bracket, such to enable a relative movement of actuator and tab with at least two degrees of freedom.

11 Claims, 8 Drawing Sheets

DEVICE FOR CONTROLLING TRIM OF A BOAT

FIELD OF THE INVENTION

The present Application relates to a device for controlling the trim of a boat, comprising at least one trim tab element or the like, which is attached to the transom of the boat through a hinge.

This system comprises at least one actuator, which is attached by an upper terminal to the transom and by a lower terminal to the tab through an upper joint and a lower joint respectively, the lower joint being composed of at least two parts, i.e. a first part connected to the lower terminal and a second part attached to said tab.

BACKGROUND OF THE INVENTION

This is the typical configuration of prior art devices, which are typically used both on boats and on aircrafts for trim control.

Particularly, many boats currently use trim tabs mounted to the transom for trim control during navigation. Trim tabs, which are also known as "stabilizers", "trim controls" or "flaps" are movable plate-like extensions of the hull, usually made of metal, that are hinged to the transom flush with the keel and driven by one or more cylinder actuators to variously tilted positions relative to the keel.

Like in aircraft flaps, appropriate control of boat trim tabs provides control of the hydrodynamic force which tends to lift the stern, and consequently lower the bow and cause listing, thereby ensuring the ideal attitude for navigation in a variety of conditions.

Therefore, these trim control systems are widely used in boats and disclosed in various prior art documents, such as Patent Application U.S. Pat. No. 8,047,152 by the same Applicant.

As disclosed in this document, in prior art devices the actuator is attached to the tab by means of the lower bracket which includes a "fork-shaped" element, engaging with the terminal element of the actuator due to the presence of transverse holes that accommodate a pin.

The pin prevents translation between the actuator and the tab and allows the tab to rotate about an axis of rotation perpendicular to the longitudinal axis of the actuator.

Nevertheless, this arrangement is affected by problems and failures.

It the actuator and the tab are not properly mounted to the transom, e.g. in case of misalignment of the actuator and the blade, the rotation of the tab causes unexpected wear or failures, as one part of the fork-shaped element is more stressed than another.

Improper mounting is a rather likely event, as such mounting requires quite a complex procedure.

At first the tab has to be mounted as an ideal extension of the keel line, then the hinge and the actuator are attached such that the latter is perfectly perpendicular to the plane defined by the tab.

Then, the actuator is attached to the transom.

Mounting errors are clearly possible, especially due to the presence of the fork-shaped element, which inevitably has some clearance and does not allow proper inclination of the actuator.

The offset between the actuator and the tab is inevitable and causes malfunctioning and failures.

Therefore, there is yet an unfulfilled need for a device for controlling the trim of a boat, which can resolve the drawbacks of prior art devices.

SUMMARY OF THE INVENTION

The present invention fulfills the above mentioned objects by providing a device for controlling the trim of a boat as described above, in which the first part is engaged with the second part such that the actuator and the tab are allowed to move relative to each other with one degree of freedom when the tab is attached to the transom of the boat through the hinge, i.e. during normal operation, and the actuator and the tab are allowed to move relative to each other with at least two degrees of freedom when the tab is not attached to the transom.

This configuration provides two degrees of freedom when the tab is being mounted to the transom, and only one degree of freedom during operation of the tab.

Therefore, during operation, the tab has the same behavior as prior art tabs, with one degree of freedom, particularly a rotation about an axis passing through the hinge that allows the tab to be attached to the transom.

This movement in at least two degrees of freedom allows the device of the present invention to be mounted while maintaining the offset between the actuator and the tab, and preventing the movement of the tab from causing malfunctioning or failures at the interface between the tab and the actuator.

In a possible improvement, the lower joint consists of a spherical head which engages in a corresponding housing seat.

Thus, the device of the present invention has the degrees of freedom of a plane that rotates about a point, rotation occurring here about the spherical head.

As mentioned above, again, if the tab is attached to the transom, then it can only rotate about an axis perpendicular to the fore-and-aft axis for trim correction, whereas if the tab is not attached to the transom, i.e. during mounting thereof, it can also rotate about an axis parallel to the fore-and-aft axis of the boat, for tab-actuator offset.

Due to this feature, the tab may be inclined at any angle relative to the longitudinal axis of the actuator, and the inclination of the actuator may be thus adapted to various boat keels.

Therefore, the connection between the actuator terminal and the tab is never under stress, irrespective of the installation of tabs, for smooth blade motion.

The stresses resulting from improper mounting are thus reduced, an offset being provided in case of complex installations.

Furthermore, the actuator will have a longer life and an easier installation and will not be subject to failure.

Also, this configuration includes a joint composed of two elements, a head and a housing seat therefor, which are less vulnerable to the stresses caused by the sea, unlike prior art devices which have at least three components, i.e. a terminal, a fork-shaped element and a fastening pin.

The elimination of the pin is a particularly interesting aspect, as the pin is the weak part of prior art joints.

Furthermore, the use of a spherical head eliminates all tangential shear force components that may act on the joint, the axial and radial stresses being only maintained.

This provides a sturdier joint, which has a smaller number of components, and is more resistant to stresses and durable.

According to a possible embodiment, the first part comprises a terminal element consisting of a spherical head, the second part having a hemispherical housing seat for accommodating the spherical head.

In this embodiment, the spherical head is connected to the actuator, particularly to an end thereof.

As more clearly shown by certain examples, the head may be designed to be connected to the tab.

In a preferred embodiment, the second part consists of a fastening bracket which is attached to the tab by fastener means, engaging in corresponding engagement seats on the lower bracket and on the tab.

Advantageously, this lower bracket may be composed of two parts, i.e. a first part and a second part, which are clamped together by fastener members, such that the housing seat has an inner surface for engagement of the spherical head.

As more clearly shown by the figures annexed to the present Application, the two parts are so designed that their coupling arrangement provides a housing seat consisting of a surface with an angular amplitude of more than 180°, such that, once the spherical head becomes engaged with the housing seat, its translation along the longitudinal axis of the actuator is prevented.

Preferably, the fastener members and the fastener means consist of a single fastener element.

This provides an apparent advantage, i.e. a reduced number of parts of the device of the present invention, because the means that fasten the lower bracket to the tab are also the means that couple together the two parts of the lower bracket.

In a further improvement of the device of the present invention, which can optimize fabrication and minimize the number of parts, the terminal element is formed of one piece with at least part of the lower terminal of said actuator.

All the characteristics that have been described above for the lower joint can also apply to the upper joint.

Furthermore, in a possible embodiment, a given rotation of the lower bracket about an axis perpendicular to the plane of the tab allows the engagement seats on the lower bracket to mate with the engagement seats on a given type of tab.

Therefore, the lower bracket has holes that, according to its position, i.e. its rotation about an axis perpendicular to the tab, line up with the holes formed on various prior art tab types.

This affords high adaptability of the device of the invention, and particularly allows replacement of the tab with any other tab type.

In a further embodiment, the hinge consists of a plate element attached to the transom and/or the keel of the boat through fastener means such as screws or the like, which engage in corresponding fastener seats consisting of holes formed on the plate element, and communicating with corresponding holes formed on the transom and/or the keel.

The hinge has such number and positions of holes as to be able to fit various types and positions of holes on the transom and/or the keel.

Therefore, advantageously, even when the hinge has to be replaced due to wear or malfunctioning, no new holes will have to be formed on the transom, as the hinges of the inventive system are compatible with the main prior art hinge types.

Finally, according to a variant embodiment, the upper joint is composed of at least two parts, i.e. a first part connected to the upper terminal of the actuator and a second part consisting of an upper bracket, which is joined to the transom by fastener means, such as screws or the like, engaging in corresponding seats, that consist of holes formed on the upper bracket and communicating with corresponding holes on the transom.

The upper bracket further has such a number and positions of holes as to be able to fit various types and positions of holes on the transom.

BRIEF DESCRIPTION OF THE DRAWINGS

These and other features and advantages of the present invention will appear more clearly from the following description of a few embodiments, illustrated in the annexed drawings, in which.

DETAILED DESCRIPTION OF EMBODIMENTS OF THE INVENTION

Figure 1:
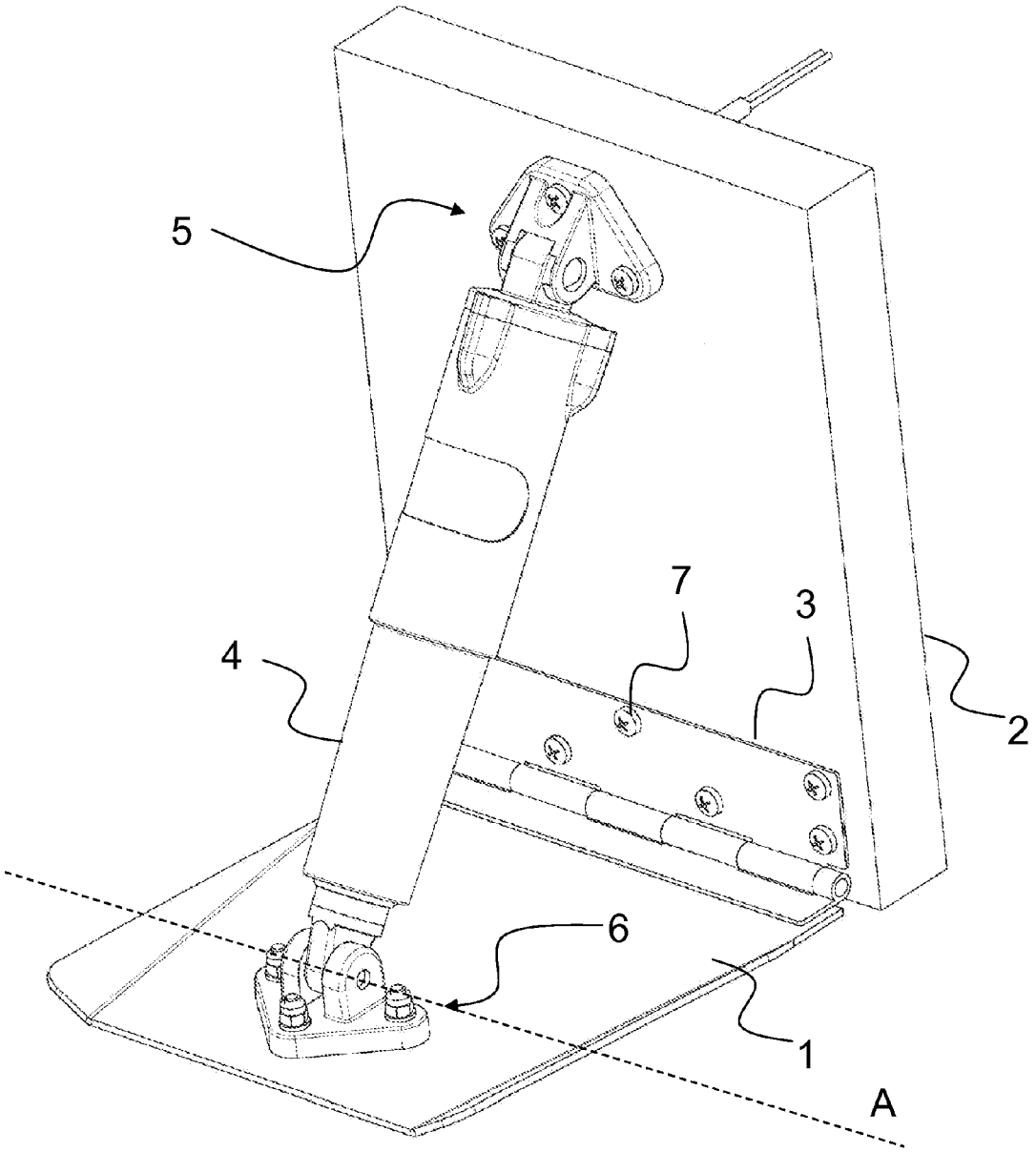
Fig. 1 (Prior Art)
FIG. 1 is a perspective view of a device for controlling the trim of a board according to the prior art.

FIG. 1 shows the device for controlling the trim of a board according to the prior art.

This device comprises at least one trim tab element 1 or the like, which is attached to the transom 2 of the boat through a hinge 3.

At least one actuator is also provided, which is attached by an upper terminal to the transom 2 and by a lower terminal to the tab 1, through an upper joint 5 and a lower joint 6 respectively.

The lower joint 6 is composed of at least two parts, i.e. a first part 61 connected to the lower end of the actuator 4 and a second part 62 attached to the tab 1.

Unlike prior art devices, the first part of the lower joint is engaged with the second part such that the actuator 4 and the tab 1 are allowed to move relative to each other with one degree of freedom when the tab 1 is attached to the transom 2 of the boat through the hinge 3, and such that the actuator 4 and the tab 1 are allowed to move relative to each other with at least two degrees of freedom when the tab 1 is not attached to the transom 2.

Preferably, the lower joint consists of a spherical head which engages in a corresponding housing seat.

Figure 2A:
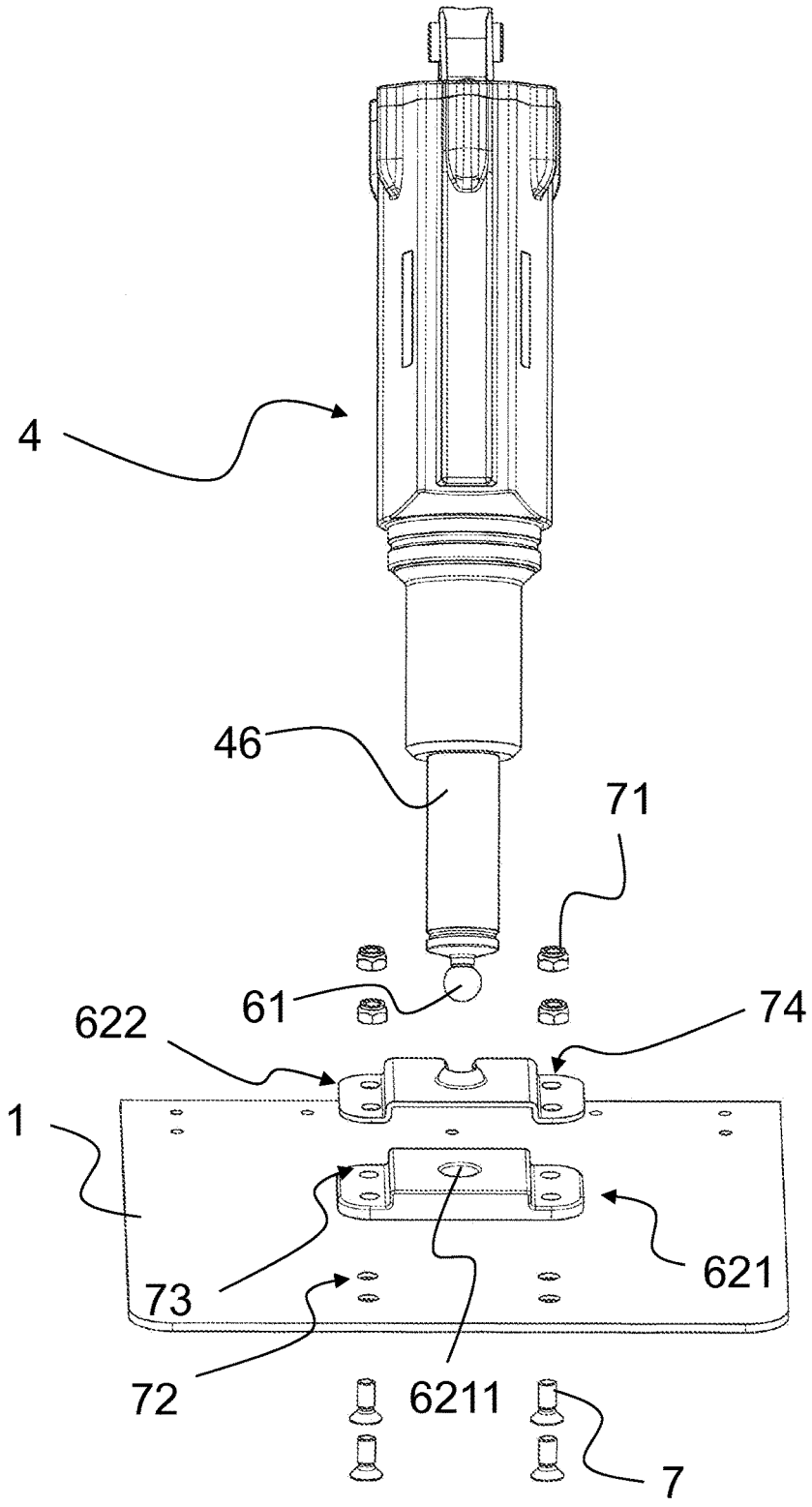
FIG. 2*a* is an exploded view of the device for controlling the trim of a board according to the present invention.
Figure 2B:
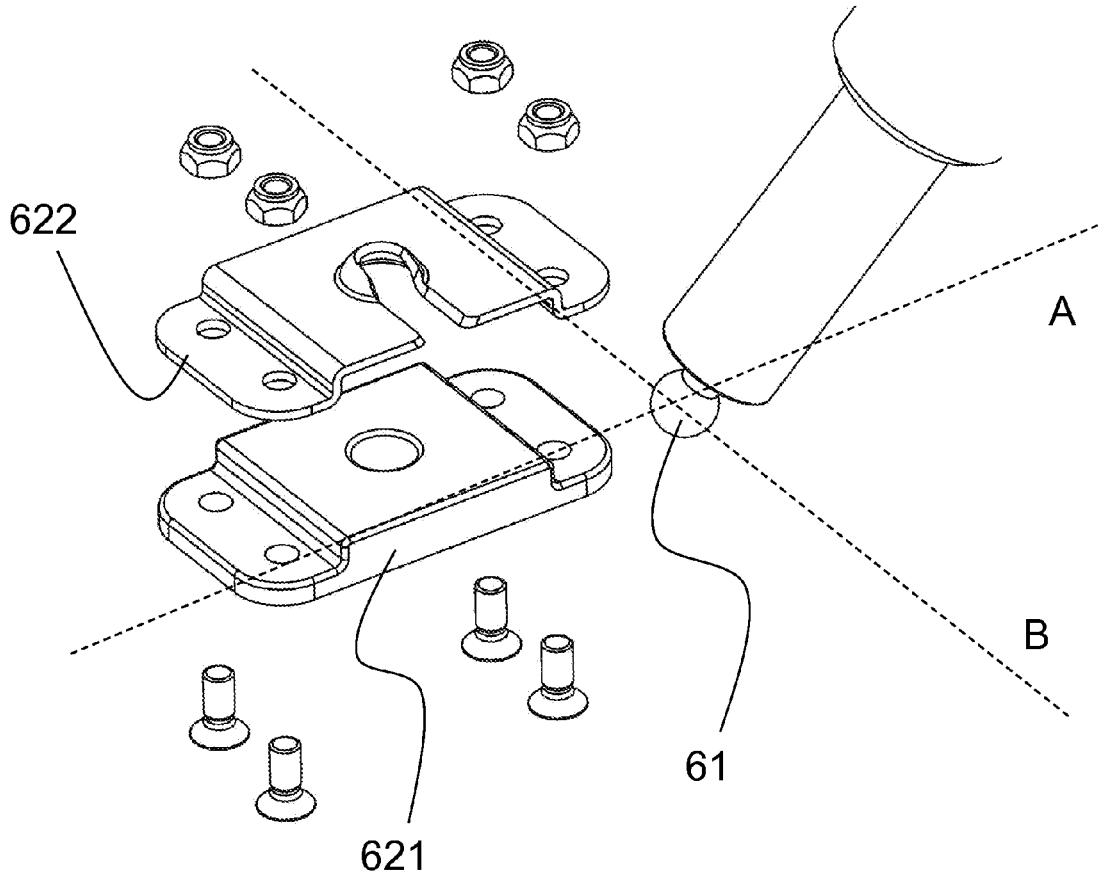
FIG. 2*b* shows a detail of FIG. 2*a;*
Figure 2C:
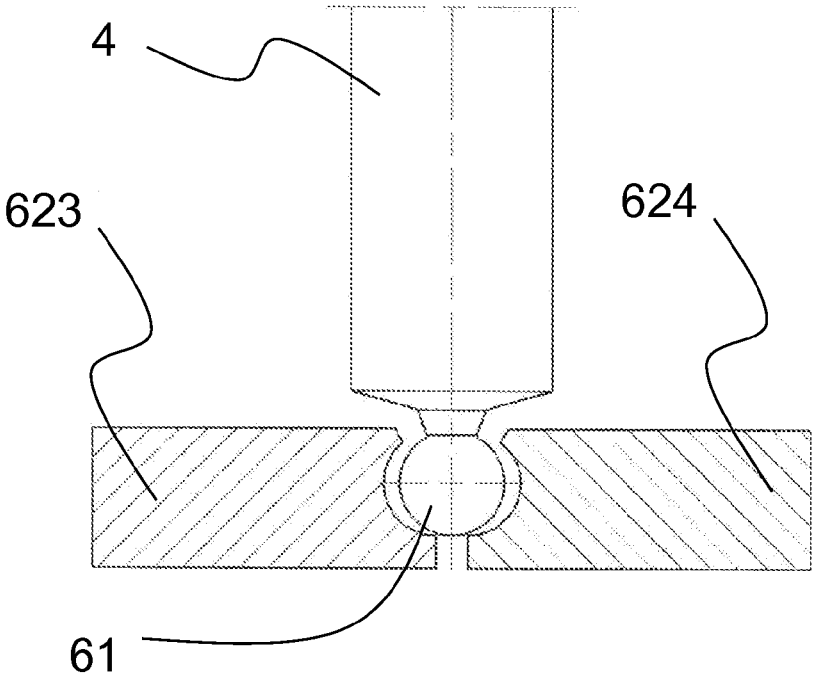
FIGS. 2*c* and 2*d* show two possible embodiments of the device of the present invention.
Figure 2D:
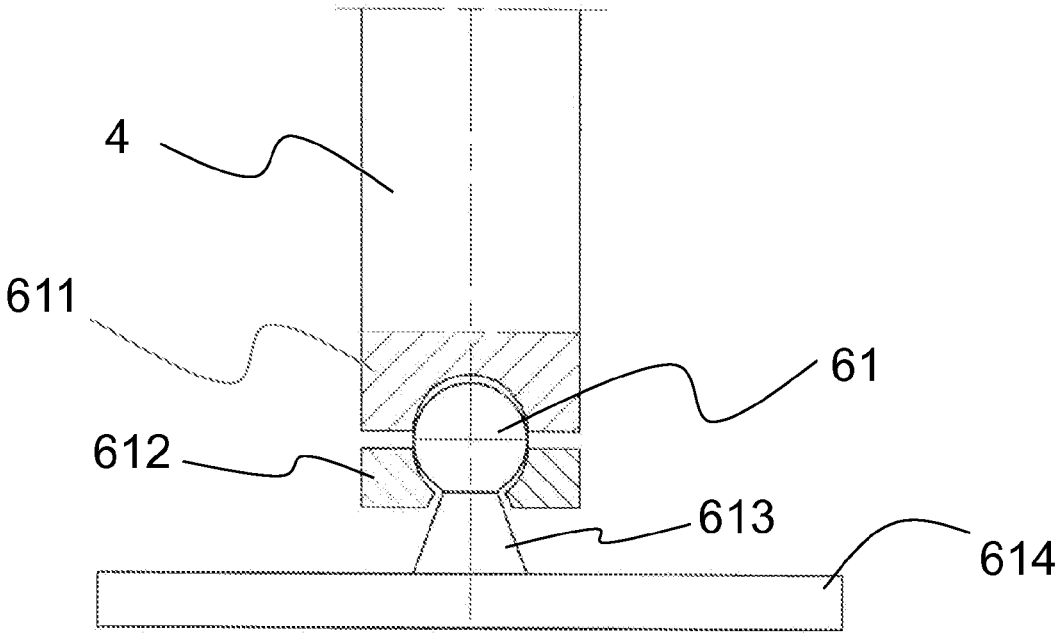

The spherical head may be designed to be connected to the actuator 4, as shown in FIGS. 2*a*, 2*b* and 2*c*, or to be connected to the tab 1, as shown in FIG. 2*d*.

FIGS. 2*a* and 2*b* show an exploded view of the device of the present invention, having the characteristics of prior art devices as described above, and where the first part 61 consists of a terminal element 61 which is accommodated in a housing seat formed on the second part 62, for the actuator 4 and the tab 1 to be allowed to move relative to each other with at least two degrees of freedom.

For example, besides rotating about the axis A of FIG. 1, the tab 1 may rotate at least about an additional axis, i.e. the axis B, perpendicular to the axis A, as shown in FIG. 2*b*.

Particularly referring to FIG. 2*a*, the terminal element consists of a spherical head 61, the second part 62 having a hemispherical housing seat for accommodating the spherical head 61.

Advantageously, the second part 62 consists of a lower fastening bracket 62 which is attached to the tab 1 by fastener means, engaging in corresponding engagement seats on the lower bracket 62 and on the tab 1.

Particularly, the lower bracket 62 is composed of two parts, i.e. a first part 621 and a second part 622, which are clamped together by fastener members.

The fastener members may have any construction known in the art: in FIG. 2*a* these members are screws 7, which are inserted in corresponding holes 72, 73 and 74 formed on tab 1, the first part 621 and the second part 622, and engage with nut fasteners 71.

The housing seat has an inner surface for engagement of the spherical head 61.

Particularly during the mounting step, the spherical head is accommodated in the housing seat 6211 formed in the first part 621 of the fastening bracket.

The housing seat 6211 consists of a hemispherical seat which receives the spherical head 61.

Then, the second part 622 of the lower bracket 62 is mounted, which has a receiving slot 6221 surrounding the upper portion of the spherical head 61.

The receiving slot 6221 is formed in such a manner that, once the second part 622 has been coupled to the first part 621, it prevents release of the spherical head 61 from the housing seat 6211.

Hence, when the two parts 621 and 622 are coupled together, the spherical head 61 is inserted in a housing seat whose surface has an angular amplitude of more than 180°.

It shall be understood that, while a preferred variant embodiment is described above, the lower bracket 62 may consist, for instance, of one piece only, and have a housing seat whose surface has an angular amplitude of more than 180°.

In this case, the spherical head 61 is forced into the housing seat 6211 during mounting.

As shown in FIG. 2*a*, the fastening screw 7 and nut 71 form a single fastener element, which can couple the first part 621 to the second part 622, while attaching the tab 1 to the lower bracket 62.

Preferably, the spherical head 61 is formed of one piece with at least part of the actuator 4, and particularly is formed of one piece with the lower terminal 46 of the actuator 4.

FIG. 2*c* shows an alternative method of fastening the spherical head 61 to the tab 1.

Particularly referring to FIG. 2*c*, the spherical head 61 is clamped between two jaws 623, 624, which may be fastened together in any fashion known in the art.

As the two jaws 623 and 624 are coupled together, they can form a hemispherical housing seat, to prevent any translation of the spherical head 61 along the longitudinal axis of the actuator 4.

Furthermore, the two jaws 623 and 624 may be attached to the tab 1, either like the lower bracket 62 was attached to the tab 1, or in any fashion known in the art.

FIG. 2*d* shows a variant embodiment of the device of the present invention, in which the spherical head 61 is attached to the tab 1 and is further connected to the actuator 4 through two jaws 611, 612.

Unlike FIG. 2*c*, the two jaws 611 and 612 are coupled together in the direction of the longitudinal axis of the actuator 4.

As described above, as the two jaws 611 and 612 are coupled, they can form a housing seat for the spherical head 61.

In one improvement of the variant as shown in FIG. 2*d*, the jaw 611 may be formed of one piece with the terminal part of the actuator 4.

Alternatively or in addition thereto, the spherical head 61 may be formed of one piece with the tab 1.

According to a further embodiment, particularly referring to FIG. 2*c*, the spherical head 61 may be designed to be supported by a rod 613 connected to a bracket 614.

The bracket 614 may be attached to the tab 1 in any manner as described above.

The spherical head 61, the rod 613 and the bracket 614 may be formed of one piece with one another and/or with the tab 1.

According to a possible embodiment, the upper joint 5 as shown in FIG. 1 also has one or more of the features of the lower joint 6 as described above.

FIGS. 3*a* to 5*c* show different variant embodiments of a device according to the present invention.

These variant embodiments are intended to illustrate the adaptability of the device of the present invention to various types of tabs.

It shall be noted that the figures below not illustrate the features of the lower joint as described above, but show a prior art arrangement for attaching the actuator 4 to the tab 1.

Irrespective of this, the above described features of the lower joint may be easily provided in combination with the variant embodiments as shown below.

FIGS. 3*a* to 3*d* show four views of the system for controlling the trim of boats as taken along different planes.

Figure 3A:
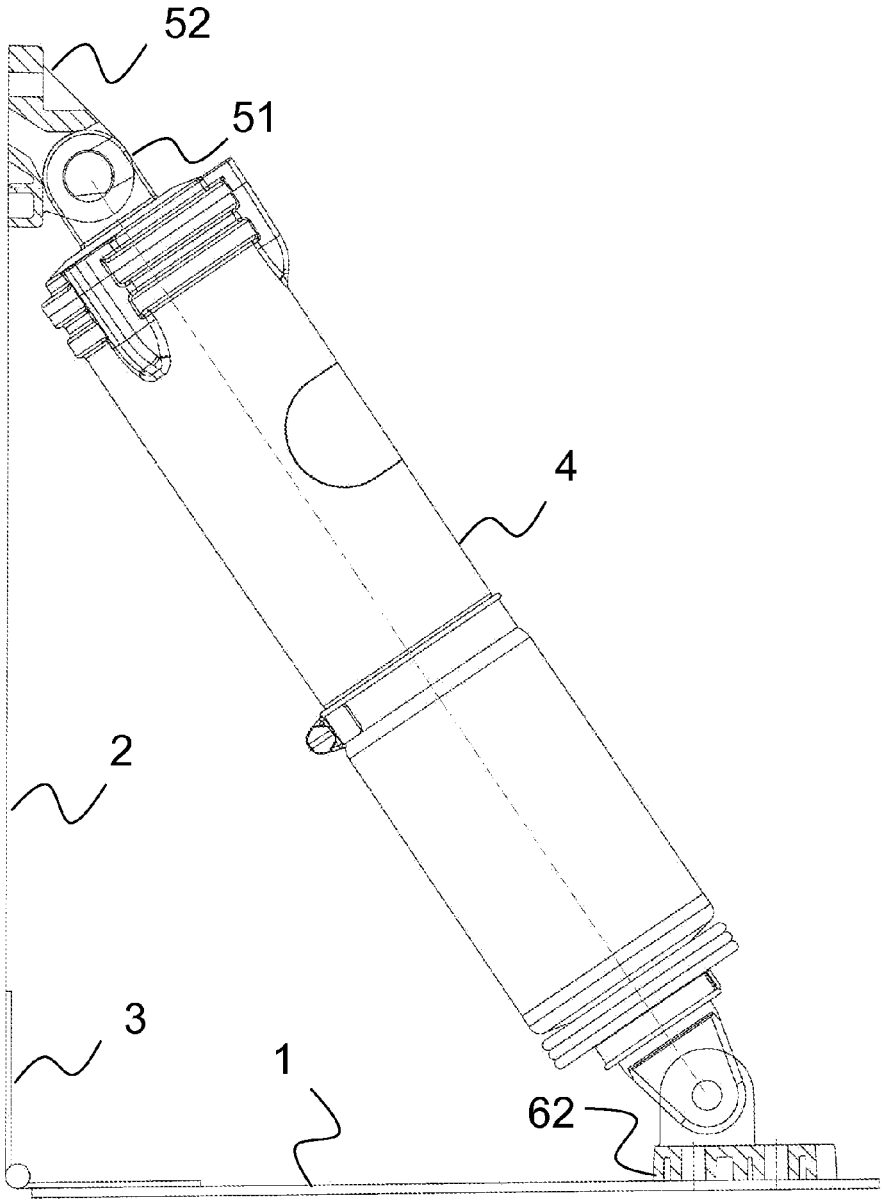
FIGS. 3*a* to 3*d* show four views, as taken along lateral and horizontal planes, of two variant embodiments of the system of the present invention.
Figure 3B:
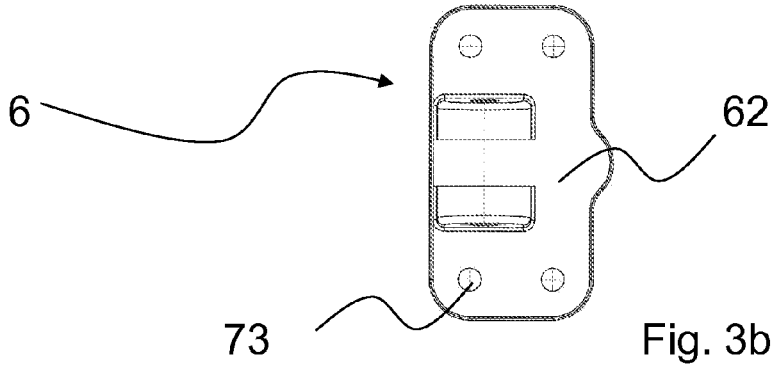
Figure 3C:
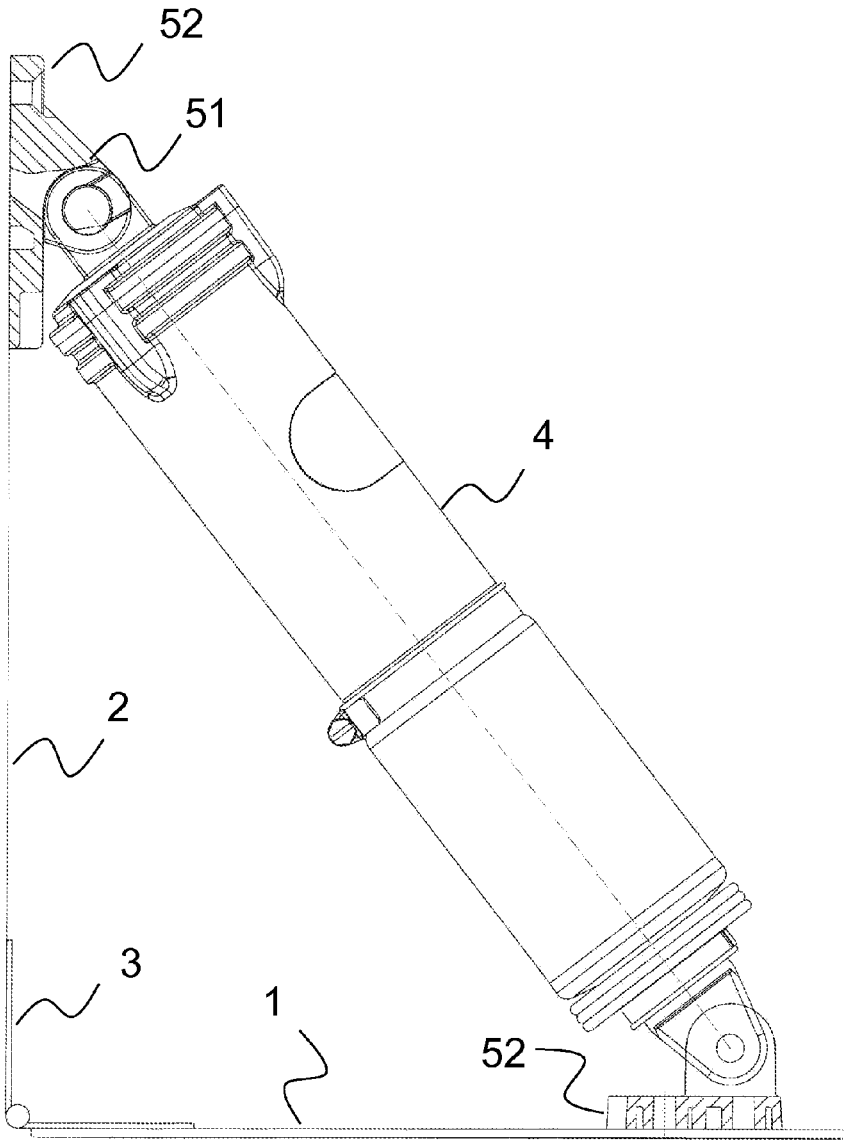
Figure 3D:
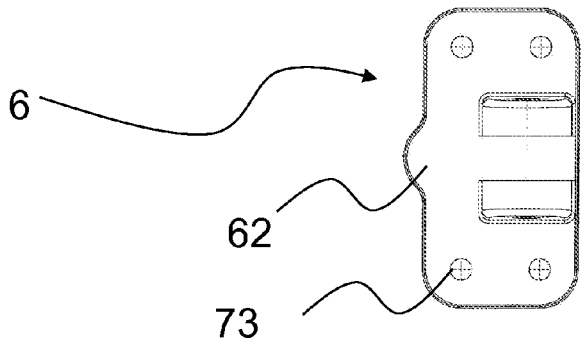

Particularly, FIGS. 3*a* and 3*c* are views of the system of the present invention as taken along a lateral plane, whereas FIGS. 3*b* and 3*d* are views of the lower bracket 62 as taken along a horizontal plane.

Namely, these figures show that a given rotation of the lower bracket 62 about an axis perpendicular to the plane of the tab 1 allows the holes 72 on the lower bracket 62 to coincide with the wholes on a given type of tab 1, such that the lower bracket 62 and, as a result, the actuator 4, can fit various types of arrangements for mounting actuators to various types of tabs 1.

Particularly, the actuator 4 of FIG. 3*a* is of a type other than the actuator 4 of FIG. 3*c*, and two different arrangements for mounting them to the tab are provided, but the particular configuration of the lower bracket 62, which is of the same type as in FIGS. 3*a* to 3*d*, allows the actuator 4 to fit various types of mounting arrangements.

FIG. 3*b* shows a top view, as taken along a horizontal plane, of the lower bracket 62, which is rotated through 180° to allow the actuator 4 to fit various mounting arrangements.

Figure 4A:
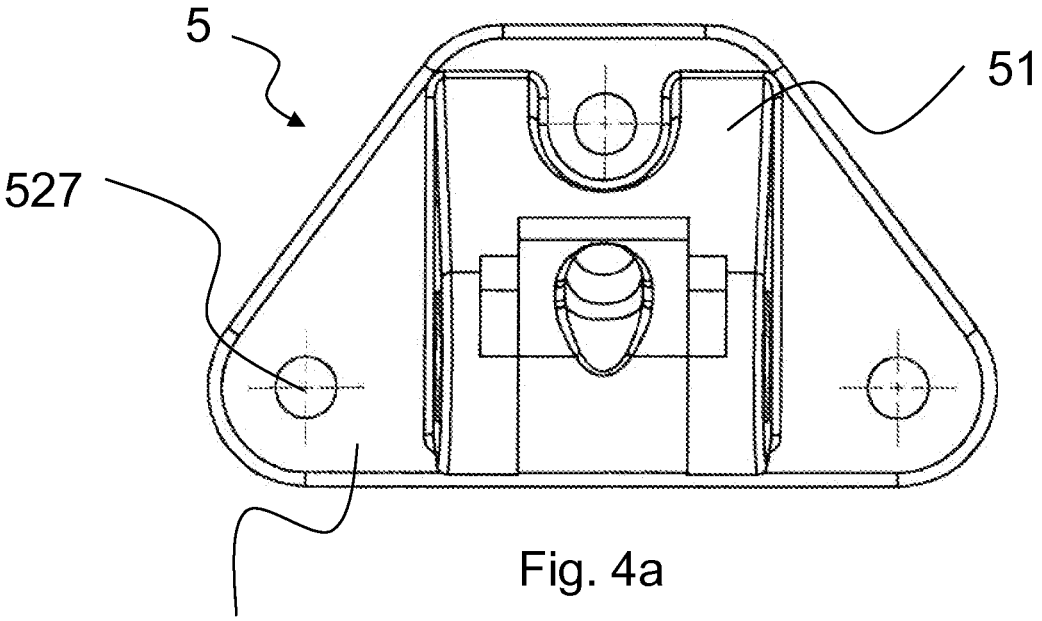
FIGS. 4*a* and 4*b* show the upper joint for connecting the actuator to the transom, as provided in the system of the present invention, according to two variant embodiments respectively.
Figure 4B:
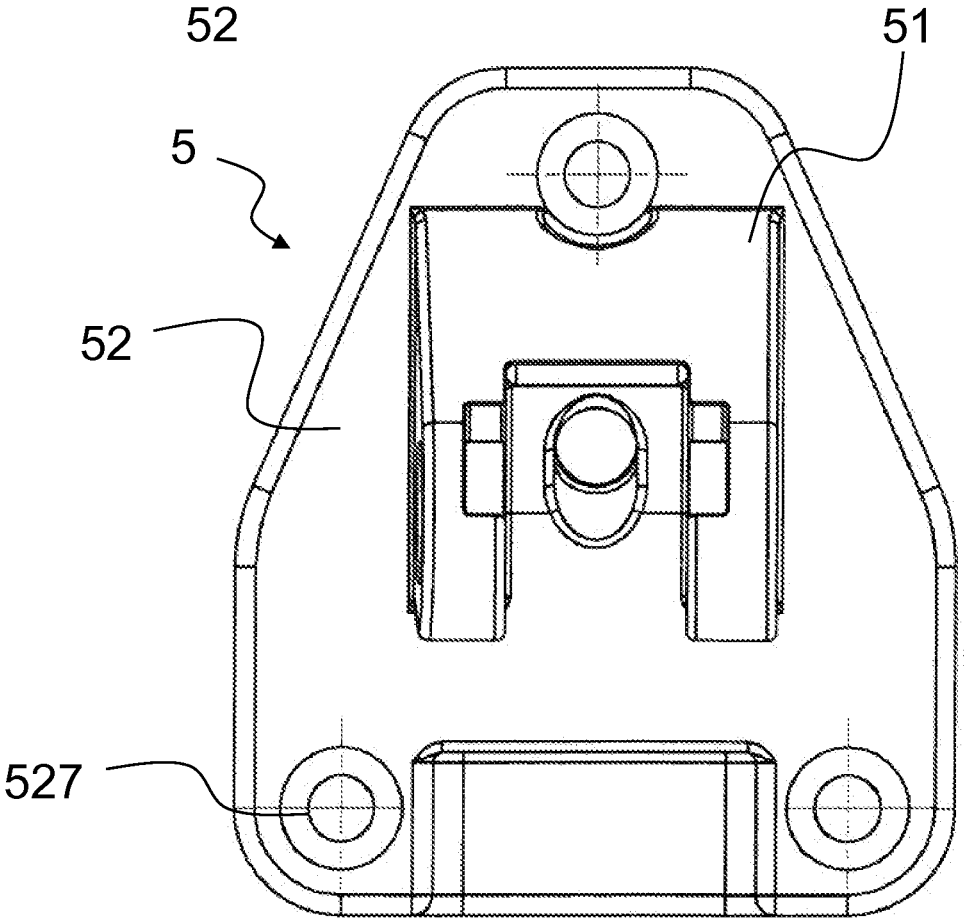

FIGS. 4*a* and 4*b* show the upper joint 5 for connecting the actuator 1 to the transom 2, as provided in the device of the present invention, according to two variant embodiments respectively.

The upper joint 5 is composed of at least two parts, i.e. a first part 51 connected to the upper terminal of the actuator 4 and a second part consisting of an upper bracket 52 attached to the transom 2 by fastener means, in much the same manner as the lower joint 6, such as screws engaging in corresponding holes 527 formed on the upper bracket 52 and communicating with holes on the transom 2.

The two embodiments of FIG. 4*a* and FIG. 4*b* differ in their upper brackets 52, and particularly each upper bracket 52 has such a number and positions of the holes 527 as to be able to fit various types and positions of holes on the transom 2.

Figure 5A:
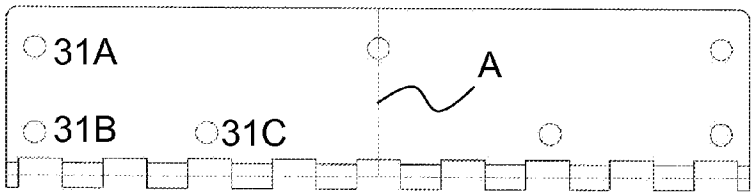
FIGS. 5*a* to 5*c* show three different variants of the hinge of the system of the present invention.
Figure 5B:
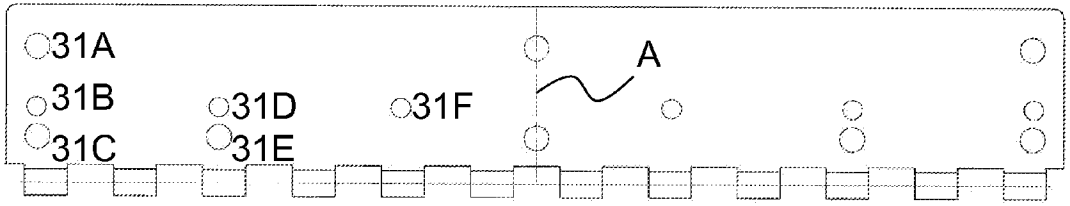
Figure 5C:
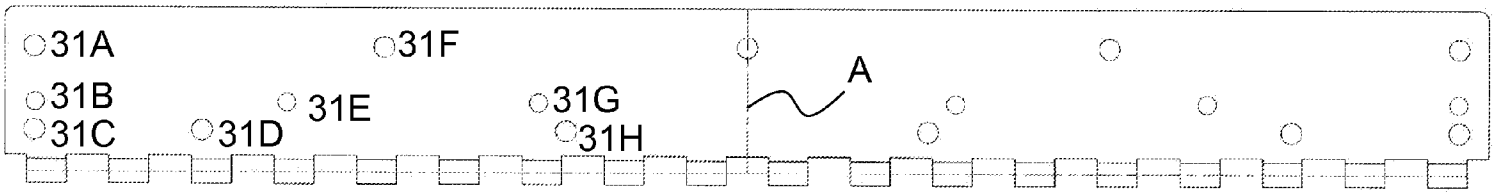

FIGS. 5*a* to 5*c* show three different embodiments of the hinge 3 designed for connection and fixation of the tab 1 to the transom 2.

In these embodiments, the hinge 3 consists of a plate element attached to the transom 2 of the boat through fastener means such as screws, which engage in corresponding fastener seats consisting of holes 31 formed on the plate element, and communicating with corresponding holes formed on the transom 2.

The different hinges 3 as shown in the figures have such a number and positions of holes 31 as to be able to fit various types and positions of holes on the transom 2.

Particularly, the sizes of hinges 3 and the positions of holes 31 are set forth below, with particular reference to the positions of such holes relative to the distance of the center of each hole from the center line A of each hinge, considering that each hole 31 to the left and/or right of the line A has a corresponding hole which is symmetrical with respect to the line itself.

The sizes and positions shall be intended by way of illustration only and without limitation to the inventive principle as disclosed hereinabove.

FIG. 5*a*

The length of the hinge 3 is 9 inches.

The distance between the holes 31A, 31B and the line A is 101.6 mm (4").

The distance between the hole 31C and the line A is 50.8 mm (2").

The holes 31B and 31C are aligned.

The distance between the hole 31A and the hole 31B is 25.4 mm (1").

FIG. 5*b*

The length of the hinge 3 is 12 inches.

The distance between the holes 31A, 31B, 31C and the line A is 139.7 mm (5.5").

The distance between the holes 31D, 31E and the line A is 89.9 mm (3.5").

The distance between the hole 31F and the line A is 38 mm (1.5").

The holes 31B, 31D and 31F are aligned, and the holes 31C and 31E are also aligned.

The distance between the hole 31A and the hole 31B is 17 mm, whereas the distance between the hole 31A and the hole 31C is 25.4 mm (1").

FIG. 5*c*

The length of the hinge 3 is 18 inches.

The distance between the holes 31A, 31B, 31C and the line A is 216.1 mm (8.5").

The distance between the hole 31D and the line A is 165.3 mm (6.5").

The distance between the hole 31E and the line A is 139.7 mm (5.5").

The distance between the hole 31F and the line A is 110.2 mm (4.35").

The distance between the hole 31G and the line A is 63.5 mm (2.5").

The distance between the hole 31H and the line A is 55.1 mm (2.17").

The holes 31A and 31F are aligned, the holes 31B, 31E and 31G are also aligned, and the holes 31C, 31D and 31H are also aligned.

The distance between the hole 31A and the hole 31B is 16.8 mm (0.66"), whereas the distance between the hole 31A and the hole 31C is 25.4 mm (1").

The invention claimed is:

1. A device for controlling trim of a boat, comprising at least one trim tab element having a tab (1) affixed to a transom (2) of a boat by a hinge (3); and at least one actuator (4), affixed by an upper terminal to the transom (2) and by a lower terminal to said tab (1) respectively through an upper joint (5) and a lower joint (6), said lower joint (6) comprising at least two parts, which include a first part (61) connected to said lower terminal of said actuator (4) and a second part (62) affixed to said tab (1), wherein said first part (61) engages said second part, thereby enabling said actuator (4) and said tab (1) to move relative to each other with one degree of freedom when said tab (1) is attached to the transom (2) of the boat through said hinge (3) during normal operation, and thereby enabling said actuator (4) and said tab (1) to move relative to each other with at least two degrees of freedom when the tab (1) is not engaged to the transom (2), wherein said first part (61) comprises a spherical head, which engages a corresponding housing seat in said second part (62), wherein said housing seat is defined in a lower fastening bracket, which is affixed to said tab (1), wherein said lower fastening bracket (62) comprises a first portion (621) and a second portion (622), which are clamped together, such that said housing seat has an inner surface for engagement of said spherical head, wherein said lower fastening bracket is affixed to said tab (1) by one or more fasteners engaging in corresponding engagement seats on the lower fastening bracket (62) and on said tab (1), and wherein said first portion and said second portion are clamped together by a fastener member.

2. The device as claimed in claim 1, wherein said housing seat is hemispherical for accommodating said spherical head (61).

3. The device as claimed in claim 2, wherein said first part is formed of one piece with at least part of said lower terminal of said actuator (4).

4. The device as claimed in claim 1, wherein said one or more fasteners and said fastener member include a single fastener element.

5. The device as claimed in claim 1, wherein a predetermined rotation of said lower fastening bracket (62) about an axis perpendicular to a plane of said tab (1) provides for the engagement seats on said lower fastening bracket (62) to coincide with engagement seats on said tab (1).

6. The device as claimed in claim 1, wherein said hinge (3) comprises a plate element attached to the transom (2) or a keel of the boat through fasteners, which engage in corresponding fastener seats consisting of holes formed on said plate element, and communicating with corresponding holes formed on the transom (2) or the keel, said hinge (3) having such number and positions of said holes to fit various types and positions of the holes on the transom (2) or the keel.

7. The device as claimed in claim 1, wherein said upper joint (5) is comprises two parts, which include a first part connected to said upper terminal of the actuator (4) and a second part consisting of an upper bracket (52) attached to said transom (2) by fasteners engaging in corresponding seats consisting of holes formed on the upper bracket (52) and communicating with corresponding holes on the transom (2).

8. A device for controlling trim of a boat, comprising at least one trim tab element having a tab (1) affixed to a transom (2) of a boat by a hinge (3); and at least one actuator (4), affixed by an upper terminal to the transom (2) and by a lower terminal to said tab (1) respectively through an upper joint (5) and a lower joint (6), said lower joint (6) comprising at least two parts, which include a first part (61) connected to said lower terminal of said actuator (4) and a second part (62) affixed to said tab (1), wherein said first part (61) engages said second part, thereby enabling said actuator (4) and said tab (1) to move relative to each other with one degree of freedom when said tab (1) is attached to the transom (2) of the boat through said hinge (3) during normal operation, and thereby enabling said actuator (4) and said tab (1) to move relative to each other with at least two degrees of freedom when the tab (1) is not engaged to the transom (2), wherein said second part (61) comprises a spherical head, which engages a corresponding housing seat in said first part (62), wherein said housing seat is defined in a lower fastening bracket, which is affixed to said tab (1), and wherein said lower fastening bracket (62) comprises a first portion (621) and a second portion (622), which are clamped together, such that said housing seat has an inner surface for engagement of said spherical head, wherein said first portion and said second portion are clamped together by a fastener member.

9. The device as claimed in claim 8, wherein said housing seat is hemispherical for accommodating said spherical head (61).

10. The device as claimed in claim 8, wherein said hinge (3) comprises a plate element attached to the transom (2) or a keel of the boat through fasteners, which engage in corresponding fastener seats consisting of holes formed on said plate element, and communicating with corresponding holes formed on the transom (2) or the keel, said hinge (3) having such number and positions of said holes to fit various types and positions of the holes on the transom (2) or the keel.

11. The device as claimed in claim 8, wherein said upper joint (5) is comprises two parts, which include a first part connected to said upper terminal of the actuator (4) and a second part consisting of an upper bracket (52) attached to said transom (2) by fasteners engaging in corresponding seats consisting of holes formed on the upper bracket (52) and communicating with corresponding holes on the transom (2).

* * * * *